US005370388A

United States Patent [19]

Wehner

[11] Patent Number: 5,370,388

[45] Date of Patent: Dec. 6, 1994

[54] APPARATUS AND METHOD FOR SETTING A GOLF TEE

[76] Inventor: Daniel R. Wehner, 312B Glen Douglas Dr., Glenshaw, Pa. 15116

[21] Appl. No.: 105,771

[22] Filed: Aug. 12, 1993

Related U.S. Application Data

[63] Continuation of Ser. No. 978,197, Nov. 18, 1992, abandoned, which is a continuation of Ser. No. 788,559, Nov. 6, 1991, abandoned.

[51] Int. Cl.[5] ..... A63B 71/00

[52] U.S. Cl. ..... 273/32.5

[58] Field of Search ..... 273/32.5

[56] References Cited

U.S. PATENT DOCUMENTS

| | | | |
|---|---|---|---|
| 2,609,198 | 9/1952 | Armstrong | 273/32.5 |
| 3,074,719 | 1/1963 | McKee | 273/32.5 |
| 3,333,848 | 8/1967 | Budzinski | 273/32.5 |
| 4,142,719 | 3/1979 | Blood | 273/32.5 |
| 4,313,604 | 2/1982 | Baxter | 273/32.5 |
| 4,951,947 | 8/1990 | Kopfle | 273/32.5 |

*Primary Examiner*—Vincent Millin
*Assistant Examiner*—Steven B. Wong
*Attorney, Agent, or Firm*—Ansel M. Schwartz

[57] ABSTRACT

The present invention is an apparatus for inserting a golf tee with a head having an underside, and a shaft extending from the underside of the head into the ground. The apparatus comprises a one-piece body member having a first end defining a threaded opening and a second end having a chamber and a shaped notch in communication with the chamber. The chamber of the one-piece body member has a circumferentially enclosed portion for containing and supporting the head of the tee as it slides to the screw member during insertion. The notch is adapted for receiving the head of the tee within the chamber. The shaped notch has a support surface upon which the underside of the head of the tee freely rests, a bottom opposing the support surface and a slot extending between the support surface and the bottom through which the shank of the golf tee extends from the chamber with the tee held in the chamber only by the underside of the head. There is also a screw member having a threaded shaft with a face.

1 Claim, 4 Drawing Sheets

APPARATUS AND METHOD FOR SETTING A GOLF TEE

This is a continuation of application Ser. No. 07/978,197 filed on Nov. 18, 1992 now abandoned which is a continuation of application Ser. No. 07/788,559 filed on Nov. 6, 1991 now abandoned.

FIELD OF THE INVENTION

The present invention is related in general to an apparatus for setting a golf tee within the ground. More specifically, the present invention is related to an adjustable tee setting apparatus which is of simple construction and can pull the tee from the ground.

BACKGROUND OF THE INVENTION

During a round of playing the game of golf, a golfer inserts a tee into the ground a number of times. The purpose of the tee is to support a golf ball at a desired height appropriate for driving the ball with a selected golf club.

Most conventionally, a tee is inserted into the ground manually. The golfer estimates by feel what height is attained when the tee is pressed into the ground. Because of this unscientific and inexact procedure, variations in height of the tee above ground are inherent, resulting in unpredictable variations in the character of the drive of a golf ball struck by a golf club. It is still more difficult for the golfer to accurately set the heights of tees corresponding to different golf clubs. All of these uncertainties are further compounded if the golfer is relatively less experienced or, as is often the case, does not actually know what should be the optimum tee height for a given club.

Setting a tee at the proper height is also made difficult because the density or hardness of the ground may vary. Sometimes, a mere difference in pressure required to insert a tee into the ground will result in different judgments by the golfer of whether the tee has been set at the proper height. Under extreme conditions, the ground may be so hard that insertion of the tee is almost impossible and sometimes a tee is intentionally broken to facilitate setting it low to the ground.

Because of one or more of the foregoing problems, various devices have been provided for use in setting a tee. These devices are typically inconvenient or cumbersome to use or are expensive or involve several components. U.S. Pat. No. 3,333,848 requires the threading of a disk within a body member. This device requires a screwdriver and typically the setting is rarely adjusted. Further, this device cannot remove the tee from the ground. U.S. Pat. No. 3,546,727 describes a tee setter which is non-adjustable and thus cannot vary the insertion depth of the tee. U.S. Pat. No. 4,896,883 describe a tee setter having notches which allow the tee to be inserted to several predetermined depths. This device has limited adjustment and cannot be used to remove the tee from the ground. U.S. Pat. No. 4,142,719 describes an adjustable tee setting having spring elements which hold the head of the tee. This device is unnecessarily complicated and cannot remove the tee once it is inserted into the ground.

SUMMARY OF THE INVENTION

The present invention is an apparatus for inserting a golf tee into the ground. The apparatus includes a handle and means for adjusting the depth in which the tee is inserted into the ground. The adjusting means is connected to the handle. There is also a support structure adjacent to the handle and the adjusting means. The support structure has a chamber in which the tee is held and from which it extends such that when the tee is inserted into the ground, the support structure is removed from the tee by a motion essentially parallel with the ground and the tee is at a desired depth in the ground. Preferably, the support structure is a one-piece body member having a hollow chamber, a first end of which defines a threaded opening and a second end defining a shaped notch adapted for receiving the head of the tee within said hollow chamber. The shaped notch defines a support surface upon which the head of the tee freely rests and a slot through which the shank of the golf tee extends from said body member. The depth adjustment means includes a screw member having a threaded shaft threadingly engaged through the threaded opening such that the shaft penetrates into the hollow chamber of the body member to an adjustable depth. The handle is used for turning the threaded shaft. Preferably, the first end of the body member projects into a recess within the handle and there are markings disposed on the body member such that the adjusted depth of the threaded shaft within the chamber can be determined by aligning the handle with the markings. The golf tee inserting apparatus provides a manner of inserting a golf tee into the ground to a consistent height. Optical illusions due to the height of grass and the like will not affect the placement of the tee. Accordingly, the geometric spacing of the golfer's stance in relationship to the tee is held constant which in turn allows for more accurate and confident golf swings.

The invention is also a method for inserting a golf tee into the ground. The method has the first step of adjusting a tee setting apparatus to a desired depth setting. Then, there is the step of placing the golf tee in contact with the apparatus. Next, there is the step of inserting the tee within the ground to the desired depth. Then, there is the step of removing the apparatus from the tee by moving it parallel with the ground. Preferably, after the removing step, there are the steps of surrounding the head of the tee by moving the setting apparatus parallel to the ground and pulling the tee setting apparatus upwards such that the tee is removed from the ground. Preferably, the adjusting step includes the step of turning a handle of the tee setting apparatus.

BRIEF DESCRIPTION OF THE DRAWINGS

In the accompanying drawings, the preferred embodiment of the invention and preferred methods of practicing the invention are illustrated in which.

DESCRIPTION OF THE PREFERRED EMBODIMENT

Figure 1:
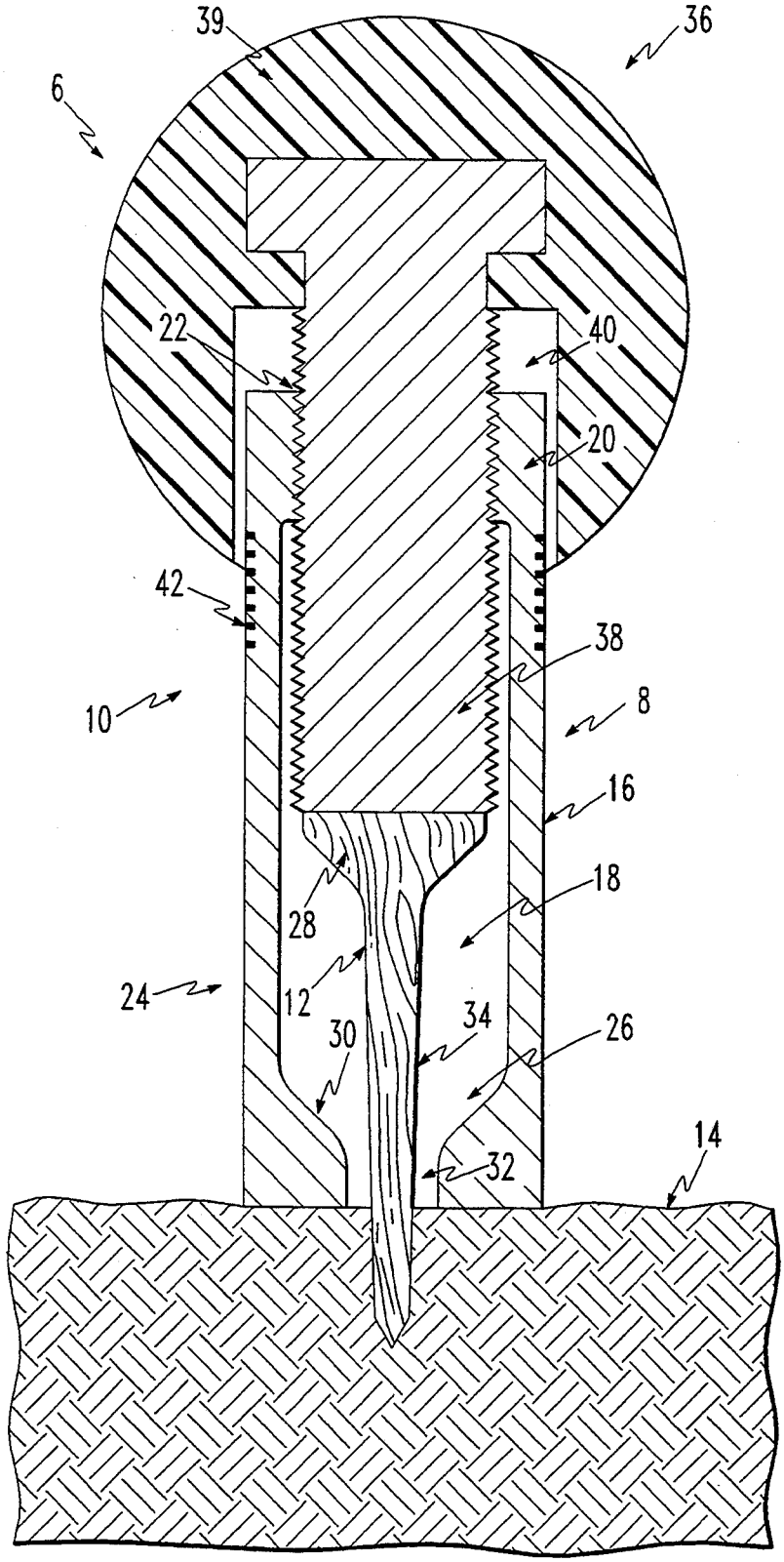
FIG. 1 is a schematic representation showing a cross sectional view of the tee setting apparatus as it inserts a golf tee into the ground.
Figure 2:
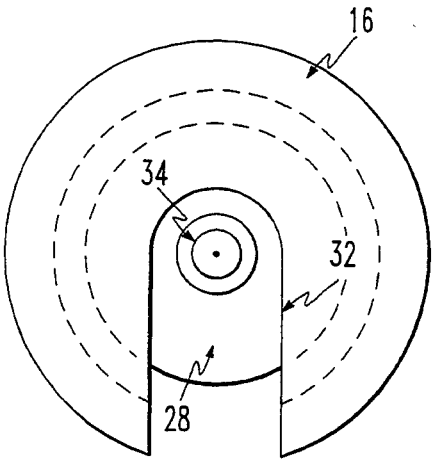
FIG. 2 is a schematic representation showing a bottom view of the body member.

Referring now to the drawings wherein like reference numerals refer to similar or identical parts throughout the several views, and more specifically to FIG. 1 thereof, there is shown an apparatus 10 for inserting a golf tee 12 into the ground 14. The apparatus 10 has a handle 39 and means 6 for adjusting the depth in which the tee 12 is inserted into the ground 14. The adjusting means 6 is connected to the handle 39. There is also a support structure 8 adjacent to the handle 39 and the adjusting means 6. The support structure 8 has a chamber 18 in which the tee 12 is held and from which it extends such that when the tee 12 is inserted into the ground 14, the support structure 8 is removed from the tee 12 by a motion essentially parallel with the ground 14 and the tee 12 is at a desired depth in the ground 14.

Figure 3:
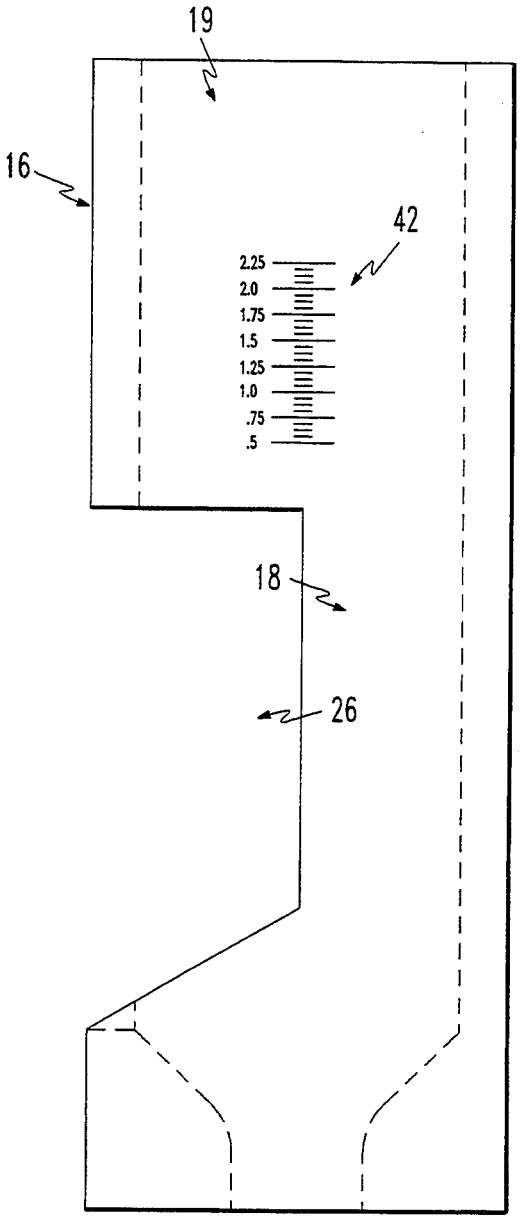
FIG. 3 is a schematic representation showing a side view of the body member.

In a preferred embodiment, the support structure 8 includes a one-piece body member 16 having the chamber 18 disposed within, a first end 20 of which defines a threaded opening 22 and a second end 24 defining a shaped notch 26 adapted for receiving the head 28 of the tee 12 within said hollow chamber 18. The shaped notch 26 defines a support surface 30 upon which the head 28 of the tee 12 freely rests and a slot 32 through which the shank 34 of the golf tee 12 extends from said body member 16. The depth adjusting means 6 includes a screw member 36 having a threaded shaft 38 threadingly engaged through the threaded opening 22 such that the shaft 38 penetrates into the hollow chamber 18 of the body member 16 to an adjustable depth. The handle 39 is used for turning the threaded shaft 38. Preferably, the first end of the body member 16 projects into a recess 40 within the handle 39 and there are markings 42 disposed on the body member 16 such that the adjusted depth of the threaded shaft 38 within the chamber 18 can be determined by aligning the handle 39 with the markings. FIG. 3 shows a side view of the body member 16 with the markings 42. As shown in FIG. 3, the chamber 18 has a circumferentially enclosed portion 19 for containing and supporting the head of the tee as it slides towards the screw member 36.

Figure 4:
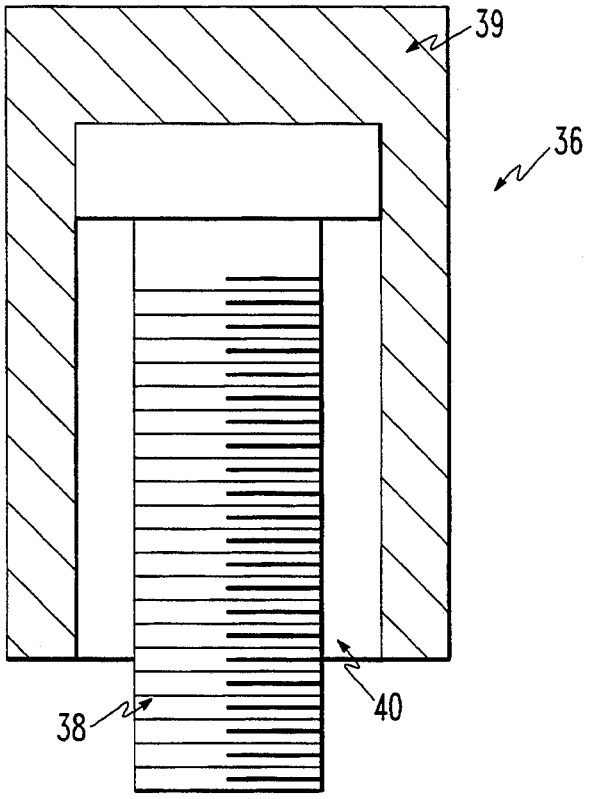
FIG. 4 is a schematic representation showing a preferred embodiment of the screw member.

In a preferred embodiment, the body member 16 is a cylinder and the handle 39 is a golf ball. Alternatively, as shown in FIG. 4, the handle can be cylindrically shaped. Preferably, the supporting surface 30 has a concave shape for accommodating the conical profile of the golf tee's head 28.

The invention is also a method for inserting a golf tee 12 into the ground 14. The method has the first step of adjusting a tee setting apparatus 10 to a desired depth setting. Then, there is the step of placing the golf tee 12 in contact with the apparatus 10. Next, there is the step of inserting the tee 12 within the ground 14 to the desired depth. Then, there is the step of removing the apparatus 10 from the tee 12 by moving it parallel with the ground 12. Preferably, after the removing step, there are the steps of surrounding the head 28 of the tee 12 by moving the setting apparatus 10 parallel to the ground and pulling the tee setting apparatus 10 upwards such that the tee 12 is removed from the ground. Preferably, the adjusting step includes the step of turning a handle 39 of the tee setting apparatus 10.

In the operation of the invention, the body member 16 is brass and has a $\frac{5}{8}$" outer diameter and is 2" long. Alternatively, the body member can be comprised of any durable material such as plastic. A Helicoil® threaded insert having 7/16" N/C is disposed within the hollow chamber 18 to form the threaded opening 22. The threaded shaft 38 is a cap screw having a length of $1\frac{1}{2}$" and matching 7/16" N/C threading. The head of the cap screw is joined to a bored-out golf ball which functions as the handle 39. The golf ball has $1\frac{5}{8}$" diameter. The cap screw is threaded through the Helicoil® such that its shaft 38 adjustably extends into the hollow chamber 18. The first end 20 of the body member 16 extends into the recess 40 of the golf ball such that the bottom of the golf ball is adjacent to the area on the body member 16 on which the markings 42 are disposed.

To set a golf tee 12, the golf ball handle 39 is first rotated until its bottom is adjacent to the desired marking thereby setting the shaft 38 of the screw member 36 to the appropriate depth within the chamber 18. A golf tee 12 is then placed within the notch such that its head 28 rests freely upon the concave supporting surface 30 and its shank 34 extends through the slot. While holding the golf ball handle, the apparatus 10 is pushed towards the ground 14. Contact of the pointed end of the shaft 38 with the grounded causes the golf tee 12 to lift off the support surface 30 and slide up within the circumferentially enclosed portion 19 of the chamber and into contact with the bottom of the cap screw's shaft 38. At this point, a desired length of shank 34 of the golf tee 12 extends from the slot 32. Further, downward pushing forces the extended length of shank 34 into the ground. The rounded surface of the golf ball allows the golfer to push comfortably with considerable force if, for instance, the ground is exceptionally hard or frozen. The golf tee inserting apparatus provides a manner of inserting a golf tee into the ground to a consistent height. Optical illusions due to the height of grass and the like will not affect the placement of the tee. Accordingly, the geometric spacing of the golfer's stance in relationship to the tee is held constant which in turn allows for more accurate and confident golf swings.

Once the golf tee 12 is set within the ground, the apparatus 10 is removed from the golf tee 12 by lifting until the head 28 is adjacent to the shaped notch 26 and then moving the apparatus parallel with the ground until the tee 12 is free from the notch 26.

Figure 5:
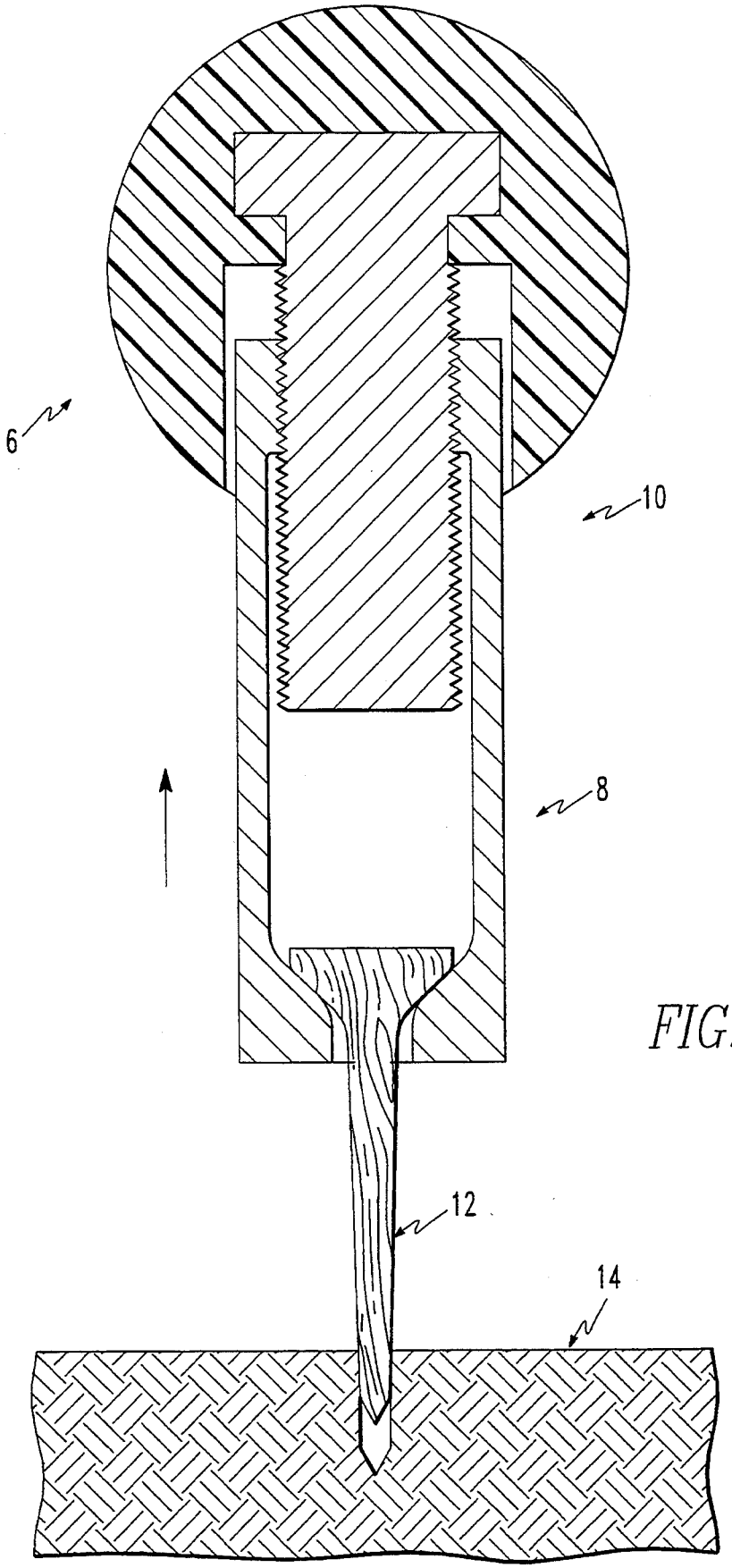
FIG. 5 is a schematic representation showing the tee setting apparatus pulling a tee from the ground.

As shown in FIG. 5, to remove the tee 12 from the ground, the apparatus is brought to the tee such that the head 28 is adjacent to the notch 26. The apparatus 10 is then moved parallel with the ground so that the slot 32 surrounds the shank 34. An upward pull causes the support surface 30 to lift the head 28 and thus the entire golf tee 12 from the ground 14.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. An apparatus for inserting a golf tee with a head having an underside, and a shaft extending from the underside of the head into the ground comprising a one-piece body member having a first end defining a threaded opening and a second end having a chamber and a shaped notch in communication with the chamber, said notch adapted for receiving the head of the tee within said chamber, said shaped notch having a support surface upon which the underside of the head of the tee freely rests, a bottom opposing the support surface and a slot extending between the support surface and the bottom through which the shank of the golf tee extends from said chamber with the tee held in the chamber only by the underside of the head; and a screw member having a threaded shaft with a face, said threaded shaft threadingly engaged through said threaded opening such that the threaded shaft penetrates into the chamber of the body member to an adjustable depth such that when the shaft of the tee held in the chamber is placed in contact with the ground for insertion therein, the apparatus moves down the tee by way of the slot moving down the shaft until the head of the tee contacts the face of the threaded shaft at which time the shaft of the tee is inserted into the ground from the force of the face on the tee head, until the bottom of the shaped notch contacts the ground, said chamber of the one-piece body member having a circumferentially enclosed portion for containing and supporting the head of the tee as it slides to the screw member during insertion, said depth in the ground the shaft is inserted defined by the depth the threaded shaft penetrates into the chamber, and after the bottom of the shaped notch contacts the ground only a movement of the apparatus in a direction parallel to the ground causes the tee to separate from the apparatus by way of the slot.

* * * * *